United States Patent [19]

Hyde et al.

[11] Patent Number: 4,669,035

[45] Date of Patent: May 26, 1987

[54] HEADLAMP AIM CAP

[75] Inventors: A. P. Stanley Hyde; Thomas E. Persing; Eugene C. Helm, all of Anderson, Ind.

[73] Assignee: General Motors Corporation, Detroit, Mich.

[21] Appl. No.: 887,591

[22] Filed: Jul. 21, 1986

[51] Int. Cl.[4] ..... F21V 17/02

[52] U.S. Cl. ..... 362/326; 362/66; 362/255; 362/327; 362/457; 362/458; 313/113

[58] Field of Search ..... 362/66, 255, 458, 457, 362/326, 327, 328; 356/121, 122; 313/317, 323, 324, 113

[56] References Cited

U.S. PATENT DOCUMENTS

| | | | |
|---|---|---|---|
| 2,867,910 | 1/1959 | Falge | 356/121 X |
| 4,318,162 | 3/1982 | Sip | 362/61 X |
| 4,429,249 | 1/1984 | Tyler et al. | 313/113 |
| 4,604,679 | 8/1986 | Rolando et al. | 362/61 X |

*Primary Examiner*—Larry Jones
*Attorney, Agent, or Firm*—Edward J. Biskup

[57] ABSTRACT

A headlamp lens having at least one of its aiming pads provided with an aim cap and a method for bonding the aim cap to the aiming pad.

4 Claims, 5 Drawing Figures

HEADLAMP AIM CAP

This invention relates to vehicle lamps and more particularly to aim adjustable headlamps having at least one of its aiming pads provided with an aim cap.

One type of headlamp enjoying increased usage on present day motor vehicles is the so-called composite headlamp which has replaceable bulbs and allows the lamp to be styled so it blends into the hood and fender configuration. When such headlamp is designed for use on vehicles, there are many variables in the manufacturing process that cause the predetermined aiming plane established by the three aiming pads on the lens to deviate from its proper position relative to the optical axis of the headlamp. As a result, one or more of the aiming pads formed on the lens may have to be increased in length so as to compensate for the deviation and permit the aiming pads to re-establish the proper position of the aiming plane. Unless this is done the entire headlamp would have to be rejected and discarded and since this could be very costly to a manufacturer, it is important to provide a process which will allow composite headlamps having a need for one or more longer aiming pads to be salvaged.

The present invention concerns such a process and more particularly relates to a method of increasing the longitudinal length of an aiming pad which has a convex outer mating surface and is formed on the outer face of a glass lens of a vehicle headlamp. In the preferred form, the headlamp and the method according to the present invention, requires a plastic cap of generally conical configuration having a concave mating surface which is complementary to the convex mating surface of the aiming pad. With the headlamp being supported in a fixture so that the headlamp reflector and lens face upwardly, an ultraviolet light curable adhesive is applied to the mating surface of either the plastic cap or of the aiming pad after which the cap is placed on the aiming pad so that the two mating surfaces are in full contact with each other with the adhesive therebetween. Ultraviolet light rays are then directed through the lens onto the reflector so as to cause the ultraviolet rays to be reflected upwardly towards the aforementioned mating surfaces of the aiming pad and cap so as to cure the adhesive and provide permanent bonding of the cap to the aiming pad.

A more complete understanding of the present invention can be obtained from the following detailed description when taken with the drawings in which.

Figure 1:
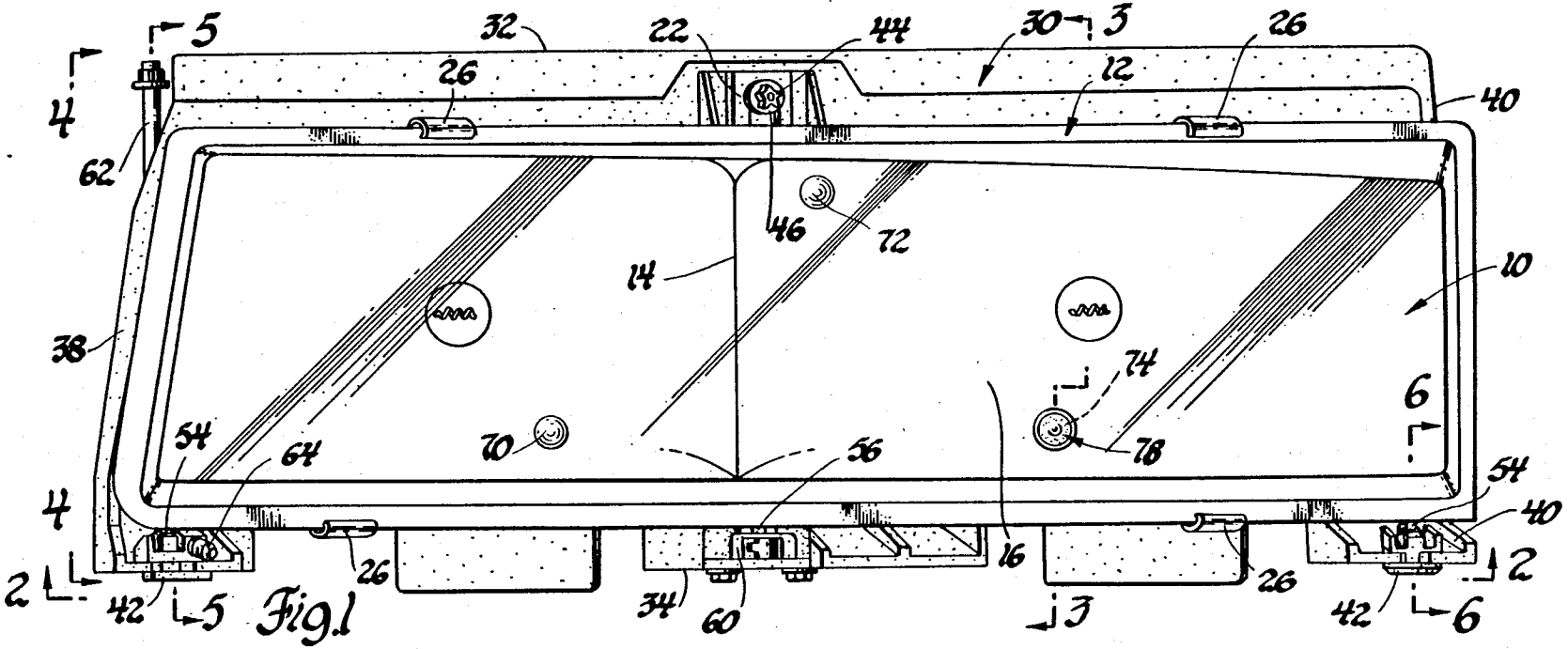
FIG. 1 is a front elevational view of a vehicle headlamp assembly having an extension or aim cap bonded to each of the aiming pads of the headlamp lens in accordance with the present invention.
Figure 2:
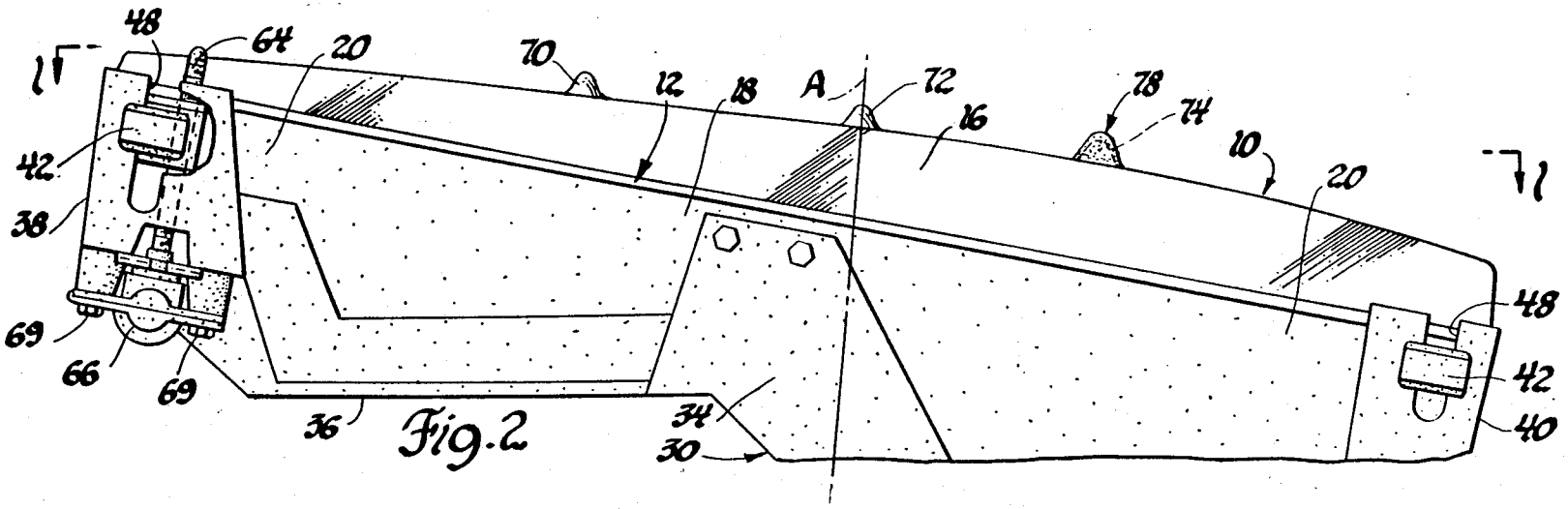
FIG. 2 is a bottom view of the vehicle headlamp assembly shown in FIG. 1.
Figure 3:
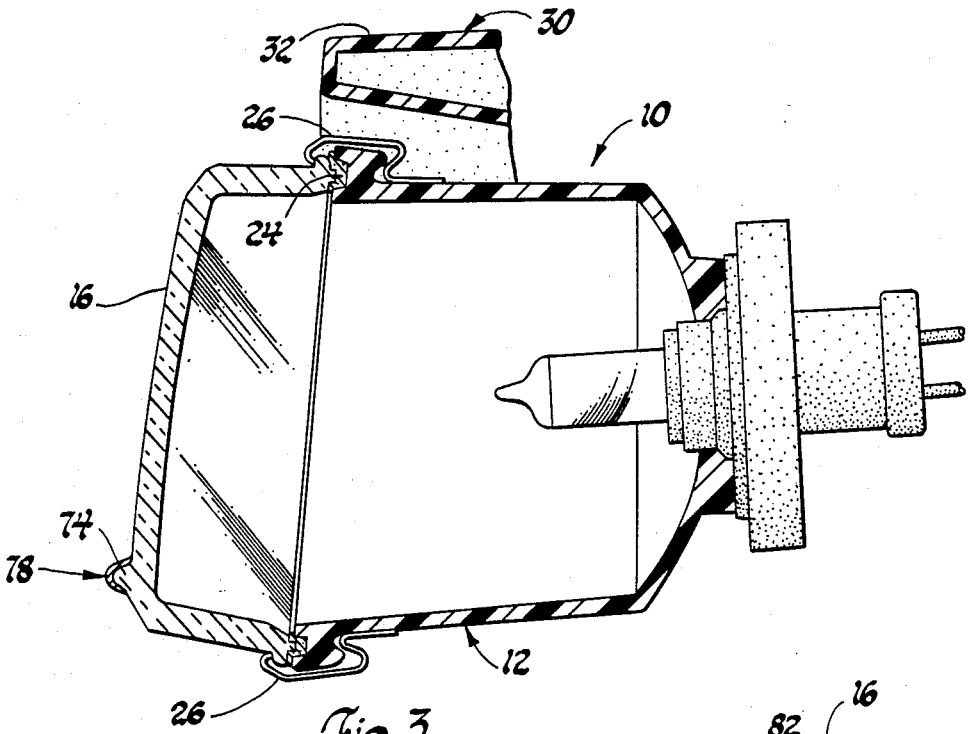
FIG. 3 is a sectional view of the headlamp assembly taken on line 3—3 of FIG. 1.

Referring now to FIGS. 1–3 of the drawings, the same illustrate the so-called styled composite headlamp variety of upscale automotive vehicle bodies. Such headlamp assembly includes a headlamp body 10, comprised of an elongated, dish-like, multiple cavity reflector member 12, the cavities of which may be separated by a web or webs 14, and the open front face of which is covered by a glass lens element 16. As viewed best in FIG. 3, the reflector member 12 may be molded of a suitable polymer, particularly to include a variety of thickened portions for provision of mounting details as will be described. Such thickened portions include a region 18 at the lower margin of the reflector adjacent web 14, and similar such regions 20, FIG. 2, at opposite lateral ends of the reflector member. Reverting to FIG. 1, another thickened flange area 22 is provided above the web 14. As seen in FIG. 3, suitable grooving or channeling, as at 24, is provided around the entire margin of the open face of the reflector 12 to receive the flange like margins of the lens 16. An adhesive and sealant such as butyl may be added at the inner face of the reflector groove 24 to prevent the ingress of foreign material and the lens is retained on the reflector member 12 by clips 26. Conventional replaceable lamp bulbs are provided, as is well known, in each of the several reflector cavities for low beam, high beam or parking lamp illumination selected at the will of the driver.

As also seen in FIGS. 1 and 2, the lamp 10 is shown mounted in a box-like support frame, generally designated as 30. This frame 30 may also be fabricated of a polymer material molded to a shape, such as shown, preferably providing spaced horizontally extending upper and lower walls 32 and 34, respectively, joined by a back wall 36 and by opposite end walls 38 and 40. Frame 30 is suitably affixed to the front body structure, not shown, of the vehicle body by whatever conventional means desired, and as shown in FIG. 2, due to the rounded aerodynamic styling of present day vehicles, the frame 30 and lamp body 10 will be angled relative to the longitudinal center axis of the vehicle to follow the contour of the vehicles. The light rays emanating from the reflector 12 are essentially parallel to the optical axis A which in turn is parallel to the longitudinal center axis of the vehicle.

The lamp body 10 is mounted on support frame 30 by a pair of slidable support shoes 42 as well as by an upper adjustable fastener 44. Fastener 44 is the usual threaded element having a head 46 suitably tooled for reception of a hand adjusting device, such as a screw-driver, and having a threaded shank screwed into a thickened portion of the back wall 36 of the frame 30. The head portion of the fastener 44 has spaced shoulders which capture the wall in region 22 of the reflector member 12. The fastener 44 is, in the illustrated case, accessible from the front of the vehicle and normally hidden, for example, by the lower marginal edge of the lip of the vehicle hood. It might alternatively be reversed for access from the rear, with the hood open and properly mounted to flange 22.

Referring to FIG. 2, the lower wall 34 of frame 30 is slotted at the end regions thereof as at 48 to receive the support shoes 42. Each support shoe 42 is of molded polymer with integral upper and lower portions embracing in the channel-like gaps therebetween the thickness of the slotted lower wall 34 at each location. The upper portion of each such support shoe 42 is molded with a socket-like recess receiving ball head of a ball stud 54 having a threaded shank screwed into each of the opposite thickened regions 20, respectively, of reflector member 12.

The two ball heads of the ball studs 54 are located in a horizontal plane of the support frame 30 and together through their centers define an instantaneous axis of rotation for aiming adjustment of the lamp body 10 in vertical planes. Such adjustment is of course effected by manipulated rotation of fastener 44 by a screwdriver or the like.

Aiming or adjustment of lamp body 10 in the horizontal planes, on the other hand, about a vertical axis is effected by manipulation of one of the shoes 42. The vertical axis for such horizontal adjustment is established by the shouldered head of upper fastener 44 and a lower pivot stud 56. Such pivot stud 56 includes a threaded shank screwed into the thickened portion 18 of the reflector member and a bullet-shaped nose which is pushed through a tapered aperture into a cavity of a polymeric molded pivot seat 60 secured to the lower wall 34 of the frame 30 at a location vertically aligned with fastener 44 and proximate the horizontal axis through the ball heads of the ball studs 54. The nose of the pivot stud 56 is simply held laterally for rotation in such pivot seat 60 such that, together with the head of upper fastener 44, it defines the vertical axis of headlamp adjustment while also being sufficiently close to the horizontal adjustment axis that it offers no impediment thereto.

As earlier mentioned, support shoes 42 are slidable within slots 48 of frame 30 to provide for adjustment of the lamp body 10. The slots 48 may of course be aligned generally on circular arcs centered on the vertical axis through pivot seat 60, or on tangents thereto as might be accommodated by slight amounts of play, as between the shoes and the lower wall 34 of the frame, for example. Adjustment is effected by an angularly arranged adjustment apparatus, seen best in FIGS. 1 and 2. The present exemplary embodiment illustrates one case of a desired orientation for the apparatus, including a pair of orthogonally arranged shafts 62 and 64 which are interconnected in a housing 66. The vertical shaft 62 has a head located adjacent the upper wall 32 of the support frame at a location easily manipulated by a hand screwdriver or the like, and arranged for rotation within a support clip (not shown) attached to back wall 36 of the frame. The lower end of shaft 62 extends into the gear housing 66 which is likewise suitably attached to the back wall as by screws 69. Although not shown, the lower end of shaft 62 has mounted thereto one of a pair of bevel gears which are meshed and suitably journaled in circular recesses of the gear housing 66. The other of the bevel gears is mounted at the internal end of the other shaft 64. As illustrated, the shaft 64 has the majority of its length threaded, such threaded length of the shaft is engaged in a threaded bore of the upper portion of a shoe 42.

Thus, a selected rotation by a screwdriver or the like applied to the head of shaft 62 will cause rotation of the lower threaded shaft 64 within its gear housing 66, resulting in a sliding adjustment of the engaged support shoe 42 and its opposite member fore or aft in their slots 48, so that the headlamp body 10 is adjusted or aimed relative to frame 30 about the vertical axis defined on the latter.

Figure 4:
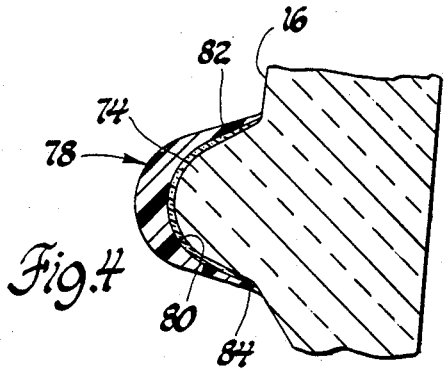
FIG. 4 is an enlarged view of the aiming pad provided with an extension cap as seen in FIG. 3.

In view of the above description, it should be apparent that the lamp body 10 is aimed about a vertical axis and a horizontal axis by selective rotation of the shaft 62 and the fastener 44. As seen in FIGS. 1, 2, and 3, the outer surface of the lens is provided with three aiming pad members 70, 72, and 74. Each of the aiming pad members 70, 72 and 74 is made of glass integral with the glass lens 16, and the aiming pad member 74 includes a conical extension or aim cap 78 which is bonded to the aiming pad member 74 as seen in FIG. 4. The cap 78 serves to increase the longitudinal length of the aiming pad member 74 and permits the aiming plane to be established in the correct predetermined position relative to the optical axis A. As is well known, the aiming plane established by each of the aiming pads must bear a known and predetermined relation with the actual optical axis of the projected beam or a selected portion thereof to allow re-aiming of the headlamp using prescribed aiming equipment. Therefore, when the aiming plane is not in the correct predetermined position relative to the optical axis A of the headlamp, one or more of the aiming pad members 70, 72 or 74 may have to be increased in longitudinal length. In this case, and in accordance with the present invention, the aiming pad member 74 is provided with the cap 78 to establish the corrected aiming plane. As described above, only one of the aiming pad members requires the cap 78 to provide the necessary extension. However, at times and if needed, two of the aiming pad members may have to be provided with a cap 78 of an appropriate length to establish the properly located aiming plane.

As best seen in FIG. 4, the cap 78 is generally conical in configuration having an outer spherical surface. The cap has a concave cavity formed therein which provides a spherical mating surface 80 defined by an annular skirt 82 which is tapered to a thin terminal edge 84. In the preferred form the cap 78 is made of a plastic material such as polymethylmethacrylate available from Rohn & Haas Company, Bristol, Pa. 19007, and identified as crystal clear acrylic V(052). The mating surface 80 is sized and configured so as to be complementary to the outer convex surface of the accommodating aiming pad member. Also, the cap 78 may be sized so it has a predetermined known length so as to allow one to provide an exact length needed for establishing the properly located aiming plane.

Figure 5:
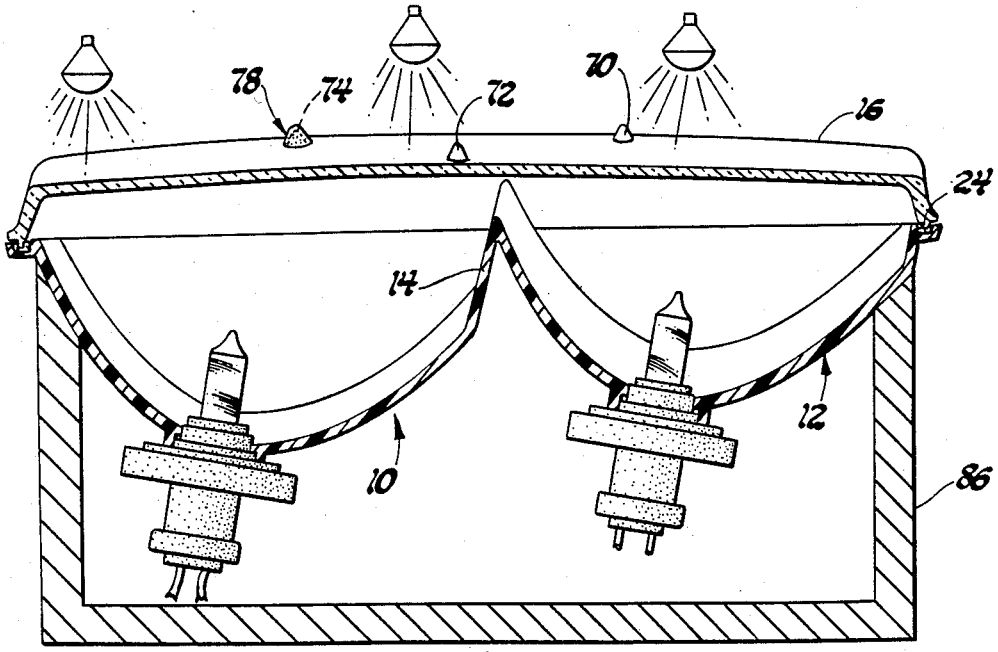
FIG. 5 shows the headlamp assembly of FIGS. 1 and 2 supported in a fixture and positioned below a source of ultraviolet light.

During the bonding operation of the cap 78 to the aiming pad member 74, the headlamp 10 is initially positioned within a support fixture 86 with the reflector 12 and lens 16 facing upwardly as seen in FIG. 5. The aiming pad member 74 is then wiped with isopropyl alcohol and is allowed to dry. An ultraviolet light activated adhesive is then applied to either the mating surface 80 of the cap or to the outer convex surface of the aiming pad member 74 which is to receive the cap 78. The cap 78 is then placed on the aiming pad 74 after which the adhesive is subjected to the activating or setting ultraviolet light for approximately 10 seconds to cure the adhesive and bond the cap 78 to the aiming pad member 74. It will be noted that inasmuch as the acrylic material of the cap 78 is ultraviolet stabilized and therefore will not allow the ultraviolet light to pass through the cap 78, the ultraviolet light is directed through the glass lens 16 and is then reflected by the reflector 12 to pass through the bottom of the aiming pad member 74 to effect the adhesive cure and bond the cap 78 to the aiming pad.

An adhesive that has been successfully used for effecting a good bond between the cap 78 and the aiming pad member 74 is a clear ultraviolet light activated adhesive available from American Chemical and Engineering Co., 51 Greenwoods Rd., Torrington, Conn., 06790 and identified as Light Weld 20088. In performing the above process, it will be noted that prior to placing a cap 78 onto the aiming pad 76, the cap 78 should first be washed in a cleaner identified as SD-33 Concentrate (Super Decontamine Model 8819-15) manufactured by American Intersciences, P.0. Box 14448, Tampa, Fla. 33690 for Cole-Parmer Instrument Company, 7425 North Oak Park Ave., Chicago, Ill. 60648 after which the cap 78 is rinsed in de-ionized water and dried.

Various changes and modifications can be made in the above-described method without departing from the spirit of the invention. Such changes and modifications are contemplated by the inventors and they do not wish to be limited except by the scope of the appended claims.

The embodiments of the invention in which an exclusive property or privilege is claimed are defined as follows:

1. In combination with a headlamp lens having a plurality of aiming pads each of which is provided with a convex outer surface, a cap mounted on one of said plurality of aiming pads for increasing the longitudinal length of said one or more of said aiming pads, said cap having a cavity formed therein which is sized and shaped so as to provide a mating surface complementary to said convex outer surface of said one or more of said aiming pads, and an adhesive provided between said mating surface of said cap and said outer convex surface of said aiming pad for bonding said cap to said aiming pad.

2. In combination with a headlamp glass lens having a plurality of aiming pads each of which is provided with a convex outer surface, a cap made of an acrylic material mounted on one of said plurality of aiming pads for increasing the longitudinal length of said one or more of said aiming pads, said cap being generally conical in configuration and having a cavity formed therein which is sized and shaped so as to provide a mating surface complementary to said convex outer surface of said one or more of said aiming pads, and an ultraviolet light activated adhesive provided between said mating surface of said cap and said outer convex surface of said aiming pad for bonding said cap to said aiming pad.

3. A method of increasing the longitudinal length of an aiming pad having a convex outer mating surface formed on the outer face of the glass lens of a vehicle headlamp, said method comprising the steps of providing a plastic cap having a concave mating surface complementary to said convex mating surface, supporting said headlamp in a fixture with the lens of said headlamp facing upwardly, applying an ultraviolet light curable adhesive on one of said mating surfaces, placing said cap on said aiming pad with the mating surfaces of said cap and said aiming cap in engagement with each other, curing said adhesive by directing ultraviolet rays through said lens so as to be reflected by said reflector to cure said adhesive from the bottom of said aiming pad.

4. A method of increasing the longitudinal length of an aiming pad having a convex outer mating surface formed on the outer face of the glass lens of a vehicle headlamp, said method comprising the steps of cleaning the convex outer mating surface of said aiming pad, providing a cap made of an acrylic material and having a concave mating surface complementary to said convex mating surface, supporting said headlamp in a fixture and lens with the reflector and lens of said headlamp facing upwardly, applying an ultraviolet light curable adhesive on one of said mating surfaces, placing said cap on said aiming pad with the mating surface of each in engagement with each other, directing ultraviolet light rays through said lens so as to be reflected by said reflector to the bottom of said aiming pad so the light rays pass through said aiming pad to cure said adhesive.

* * * * *